US006267161B1

(12) United States Patent
Barbieri

(10) Patent No.: US 6,267,161 B1
(45) Date of Patent: Jul. 31, 2001

(54) CARBON-DIOXIDE PUMP FOR TIRES

(75) Inventor: Adriano Barbieri, Bologna (IT)

(73) Assignee: Barbieri S.n.c. di Barbieri Nadia e Kalman, Argelato (IT)

( * ) Notice: Subject to any disclaimer, the term of this patent is extended or adjusted under 35 U.S.C. 154(b) by 0 days.

(21) Appl. No.: 09/533,080

(22) Filed: Mar. 22, 2000

(30) Foreign Application Priority Data

Apr. 2, 1999 (IT) ..... BO99A0157

(51) Int. Cl.[7] ..... B65B 31/00

(52) U.S. Cl. ..... 141/383; 141/19; 141/38; 141/329; 222/5; 417/460

(58) Field of Search ..... 141/19, 38, 67, 141/383, 329, 330; 222/5; 152/415; 441/90–94; 417/460, 469, 553

(56) References Cited

U.S. PATENT DOCUMENTS 3,597,780 * 8/1971 Coyle ..... 441/94
3,834,433 * 9/1974 Thompson ..... 141/392
5,316,055 5/1994 Brimmer .
5,628,350 5/1997 Gibb .
5,779,457 * 7/1998 Chuang et al. ..... 417/467
5,947,172 * 9/1999 Glotin ..... 141/383
6,164,938 12/2000 Chuang .

* cited by examiner

*Primary Examiner*—Gregory L. Huson
*Assistant Examiner*—Peter deVore
(74) *Attorney, Agent, or Firm*—Guido Modiano; Albert Josif; Daniel O'Byrne

(57) ABSTRACT

A carbon-dioxide pump for tires which comprises a dispensing head which is provided with a nosepiece for coupling to the tire valve which is connected to a threaded hole for the hermetic fixing of a bottle of carbon dioxide and to a sliding hole for a needle-equipped pin for piercing the membrane of the bottle which is rigidly coupled to a flow control element of the frustum-shaped type which can be actuated manually so as to rotate in order to hermetically close the bottle after piercing the membrane, a shell for containing the bottle which is screwed hermetically onto the head and on which a handgrip is slidingly fitted with the interposition of guiding and sliding sealing elements which are suitable to provide a short manual pump in which the air compressed by the movement of the handgrip flows between the shell and the bottle and is fed to the nosepiece through a nozzle which is closed by a valve system provided in the head.

7 Claims, 1 Drawing Sheet

CARBON-DIOXIDE PUMP FOR TIRES

BACKGROUND OF THE INVENTION

The present invention relates to a carbon-dioxide pump for tires.

Small single-use bottles of carbon dioxide for inflating tires are known; they are capable of dispensing the amount of gas required for the inflation of a single tire and their mouth is closed by a membrane which can be pierced at the time of use.

Such bottles are increasingly used because of their great convenience, since they require no physical effort, and because they can be used quickly, however they suffer drawbacks: first of all, the users tend to leave the empty bottle on the ground after use; moreover, the amount of gas contained is not always sufficient to perform complete inflation, especially for tires of the type for all-terrain vehicles, and it does not allow further use in case of subsequent need.

Moreover, during dispensing said bottles cool considerably and this is often not appreciated: the practically instantaneous dispensing of the entire content of the bottle sometimes does not allow to correctly center the tire on the wheel before final inflation.

SUMMARY OF THE INVENTION

The aim of the present invention is to obviate the above-cited drawbacks of conventional devices, i.e., to provide a carbon-dioxide pump for tires which avoids abandoning the empty bottle after use, allows several successive uses with the same bottle and even when the bottle is empty, allows use for tires of any size and type, protects the hand of the operator from the cold during use, and allows to center the tire before final inflation.

Within the scope of this aim, an object of the present invention is to provide a pump which is simple, relatively easy to provide in practice, safe in use, effective in operation and has a relatively low cost.

This aim, this object and others which will become apparent hereinafter are achieved by a carbon-dioxide pump for tires according to the present invention, characterized in that it comprises a dispensing head having a nosepiece for coupling to the tire valve which is connected to a threaded hole for the hermetic fixing of a bottle of carbon dioxide and to a sliding hole for a needle-equipped pin for piercing the membrane of the bottle which is rigidly coupled to a flow control element of the frustum-shaped type that can be actuated manually so as to rotate in order to hermetically close said bottle after piercing said membrane, a shell for containing the bottle which is screwed hermetically onto said head and on which a handgrip is slidingly fitted with the interposition of guiding and sliding sealing elements which are suitable to provide a short manual pump in which the air compressed by the movement of the handgrip flows between the shell and the bottle and is fed to said nosepiece through a nozzle which is closed by a valve system provided in the head.

BRIEF DESCRIPTION OF THE DRAWINGS

Further characteristics and advantages of the present invention will become apparent from the following detailed description of a preferred but not exclusive embodiment of a carbon-dioxide pump for tires according to the invention, illustrated only by way of non-limitative example in the accompanying drawings, wherein.

DESCRIPTION OF THE PREFERRED EMBODIMENTS

Figure 1:
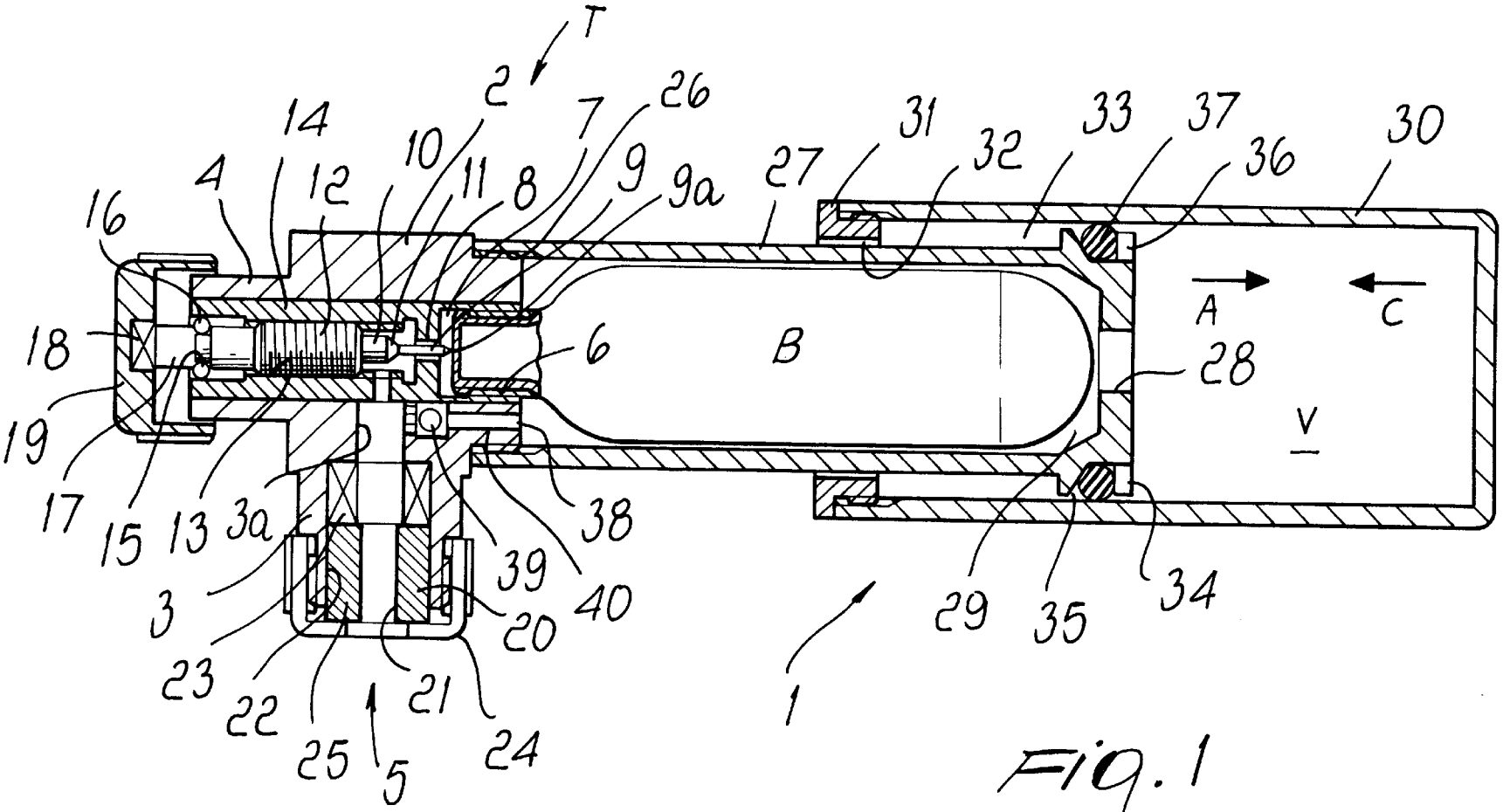
FIG. 1 is a sectional side view, taken along a diametrical plane, of a carbon-dioxide pump for tires according to the invention for bottles with a screw coupling.

With particular reference to the FIGURE, 1 generally designates a carbon-dioxide pump for tires according to the invention.

The pump 1 comprises a dispensing head T, advantageously provided by molding materials such as plastics, which is substantially shaped like two cylindrical bodies 2 and 3 arranged at right angles; a tubular metallic insert 4, made of a material such as for example brass, is rigidly coupled in the body 2 during molding; in the insert 3 there is a nosepiece 5 for coupling to the valve of the tire to be inflated, which is connected through an opening 3*a* to a threaded hole 6 of the insert 4 for fixing a carbon dioxide bottle B: the bottle B has, on its mouth, in a known manner, a pierceable membrane: the mouth of the bottle clamps a sealing gasket 7 against the bottom of the threaded hole 6.

A sliding hole 8 for a pin 9 with a needle 9*a* for piercing the membrane of the bottle B and for the escape of the gas of the bottle is axially aligned with the hole 6 in the insert 4.

The pin 9 is rigidly coupled to, and is an extension of, a flow control element 10 which has a frustum-shaped end 11 which cooperates with an advantageously frustum-shaped mouth of the hole 8.

The flow control element 10 has a threaded portion 12 which screws into a threaded portion 13 of the insert 4 and an annular groove 15 for a toroidal sealing gasket of the type known as O-Ring, which acts at a portion 16 of the cylindrical hole of the insert 4.

The flow control element continues, on the other side, with a stem 17 which ends, outside the insert 4, with a square tang 18 for coupling to a manual actuation handgrip 19. The nosepiece 5, of a known type, comprises a pad 20 which is made of a material such as rubber, is provided with an axial hole 21 and is accommodated in a seat 22 of the body 3, where it rests against an internal spacer bush 23 and is locked by a threaded ring 24 which is screwed onto the outer thread 25 of the body 3.

On the outside of the body 4 there is a threaded portion 26 for the hermetic screw coupling of a shell 27 for containing the bottle: the bottom of the shell 27 has an axial hole 28, and between the shell 27 and the bottle B a narrow interspace 29 remains whose function will be described in greater detail hereinafter.

A handgrip 30 is fitted on the shell 27 so that it can slide, as shown by arrows A and C, and is guided along the shell by means of a ring 31 which is screwed onto the mouth of the handgrip; the ring 31 is affected by internal grooves 32 which allow air to pass between the outer surface of the shell and the ring and to enter the interspace 33 that remains between the shell and the handgrip.

The bottom of the shell is externally provided with an annular raised portion 34 which has a contoured annular external seat 35, and has, toward the bottom, end openings 36 for loosely accommodating a toroidal sealing ring 37 which allows air to pass between the shell and the handgrip (and through the opening 36 in the variable-volume compartment V that remains between the internal surface of the handgrip and the bottom of the shell) during suction, as shown by arrow A, and prevents the passage of the air during compression, arrow C.

The described guiding and sliding sealing elements of the handgrip provide a short manual pump in which the air compressed by the movement of the handgrip, arrow C, flows from the bottom of the shell between the shell and the bottle and reaches said nosepiece through a nozzle 38 which is parallel to the axis of the hole 8, which is closed, during the suction of the manual pump, by a valve system constituted by a ball 39 made of a deformable material, such as rubber, which is fitted by forcing into the nozzle up to a cell 40 which is connected to the longitudinal hole of the nosepiece.

The operation of the pump according to the invention is evident: after connecting the nosepiece 5 to the valve of the tire to be inflated, in order to perform carbon-dioxide inflation it is sufficient to turn the handgrip 19, which causes the needle 9*a* to pierce the closure membrane and the bottle delivers its contents.

If one wishes to interrupt the flow of gas that arrives from the bottle B, it is sufficient to screw the handgrip 19 until the frustum-shaped portion 11 of the flow control element 10 forms a seal against the corresponding mouth of the hole 8.

In order to perform manual inflation it is sufficient to move back and forth the handgrip 30 on the shell 27: air is drawn in through the slots 32, pushed by the ring 31 through the openings 36 in the compartment V, and then pumped through the nozzle 38: the movable ring 37 allows the air to pass from 33 to V but not viceversa, whereas the ball 40 allows the air to flow from V to the tire but not viceversa.

The invention achieves the intended aim and object, and in particular, since manual inflation cannot be performed if the bottle B is not in position, it prevents the empty bottle from being abandoned after use; it is also possible to partially use the contents of the bottle; it also allows several manual uses after emptying the bottle and allows use for tires of any size and type; finally, it protects the hand of the operator from the cold during use and it allows to center the tire before final inflation.

The invention thus conceived is susceptible of numerous modifications and variations, all of which are within the scope of the inventive concept; all the details may furthermore be replaced with other technically equivalent elements.

In practice, the materials used, as well as the shapes and the dimensions, may be any according to requirements without thereby abandoning the scope of the protection of the appended claims.

The disclosures in Italian Patent Application No. BO99A000157 from which this application claims priority are incorporated herein by reference.

What is claimed is:

1. A carbon-dioxide pump for tires connectable to a carbon dioxide bottle, comprising: a dispensing head; a nosepiece, located at said dispensing head, for coupling to a tire valve; a threaded hole, connected to said nosepiece, to which the bottle of carbon dioxide is hermetically fixable; a sliding hole connected to said threaded hole; a needle-equipped pin slideable in said sliding hole for piercing a membrane of the bottle; a flow control element of a frustum-shaped type which is manually actuatable so as to rotate in order to hermetically close said bottle after piercing said membrane, said flow control element being rigidly coupled to said pin; a shell for containing said bottle which is screwed hermetically onto said head; a handgrip slidingly fitted on said shell; a nozzle provided in said head; a valve system for closing said nozzle; and guiding and sliding sealing elements interposed between said shell and said handgrip for providing a short manual pump arrangement in which air compressed by movement of the handgrip with respect to said shell flows between the shell and the bottle and is fed to said nosepiece through said nozzle which is closed by said valve system provided in the head.

2. The pump of claim 1, comprising an insert made of a metallic material and having a through hole, said threaded hole for fixing the bottle and said sliding hole being mutually aligned and being formed in said insert in communication with said through hole.

3. The pump of claim 2, comprising, at a bottom part of said shell, at least one opening for passage of compressed air from said handgrip, and a contoured annular outer seat with end openings; a toroidal sealing ring, arranged at said seat, so as to allow the air to pass between the shell and the handgrip during suction and to prevent said passage during compression.

4. The pump of claim 2, wherein said nosepiece is arranged with an axis thereof perpendicular to a longitudinal axis passing through the fixing threaded hole of the bottle and through the needle-equipped pin.

5. The pump of claim 4, comprising: a seat, provided in said head; and a locking threaded ring, said nosepiece including a pad made of an elastic material, preferably rubber, and having an axial hole, said pad being accommodated in said seat of said head and being locked by said threaded ring which is screwed onto said head.

6. The pump of claim 5, comprising a cell connected to said nosepiece, said valve system including a ball made of deformable material, preferably rubber, which is forcedly inserted into said nozzle up to said cell which is connected to said nosepiece.

7. The pump of claim 6, further comprising: a threaded portion provided at said flow control element which screws into a corresponding threaded portion of said through hole of the insert; a toroidal sealing gasket of the O-Ring type located at a cylindrical portion of said through hole of the insert; a stem connected to said flow control element; and a manual actuation handgrip, arranged at a free end of said stem.

* * * * *